United States Patent [19]

Müller

[11] 4,175,880

[45] Nov. 27, 1979

[54] DEVICE FOR INTERLOCKING PERFORATED WRITING MATERIAL

[75] Inventor: Wilhelm Müller, Frankfurt, Fed. Rep. of Germany

[73] Assignee: Postalia GmbH, Offenbach am Main, Fed. Rep. of Germany

[21] Appl. No.: 831,107

[22] Filed: Sep. 16, 1977 (Under 37 CFR 1.47)

[30] Foreign Application Priority Data

Sep. 6, 1978 [DE] Fed. Rep. of Germany ..... 2640090

[51] Int. Cl.[2] ..... B42F 3/02

[52] U.S. Cl. ..... 402/48; 402/53

[58] Field of Search ..... 402/48, 49, 50, 51, 402/52, 53

[56] References Cited

U.S. PATENT DOCUMENTS

| | | | |
|---|---|---|---|
| 948,502 | 2/1910 | Eichorn | 402/52 |
| 1,044,753 | 11/1912 | Cooley | 402/48 |
| 2,046,007 | 6/1936 | Unger | 402/53 |
| 2,308,777 | 1/1943 | Pitt | 402/53 |
| 3,251,260 | 5/1966 | Serdechny | 402/52 X |
| 3,647,306 | 3/1972 | Chamberlin | 402/48 |

*Primary Examiner*—Harrison L. Hinson
*Attorney, Agent, or Firm*—Herbert L. Lerner

[57] ABSTRACT

Device for interlocking a stack of writing material having perforations formed therein along a margin thereof, the perforations formed in the writing material being aligned in the stack thereof so as to form respective through-bores extending from opposite marginal surfaces of the stack that are disposed adjacent to and on both sides of a back surface of the stack, includes two binding strips of identical construction, each of the binding strips having a first portion engageable with the back of the writing-material stack for covering at least part thereof, and a second portion engageable with and covering a respective one of the opposite marginal surfaces of the stack, each of the binding strips further having stringing rods and sleeves extending from the respective second portion thereof, the rods and sleeves being disposed in mutually alternating sequence and having a mutual spacing corresponding to the spacing of the aligned holes formed in the stack of writing material, the rods being formed with outer detents along the length thereof and the sleeves being formed with corresponding inner detents along the length thereof, the rods of each of the two binding strips being lockingly engageable in the sleeves of the other of the two binding strips by the detents thereof within the respective through-bores formed in the stack of writing material.

13 Claims, 5 Drawing Figures

DEVICE FOR INTERLOCKING PERFORATED WRITING MATERIAL

The invention relates to a device for interlocking perforated writing material and, more particularly, formed of a binding strip engaging around the back of the writing material and covering at least the margins of the book formed of the stack of writing material that is to be strung together, the binding strip having, in the region of the book margins stringing perforations in registry in the writing material, for passage therethrough of round-profiled stringing rods of a severable synthetic material which are anchored at one end thereof to the binding strip and which are securable at the other end thereof in a locking plate, the stringing rods being formed along the entire length thereof with detents for engaging in correspondingly constructed sleeves of the locking plate likewise formed of synthetic material.

Such a device has become known heretofore from German Published Prosecuted Application DT-AS No. 1,211,591.

A disadvantage of the heretofore known device is that with heavy unbound writing material, locking by the locking plate of the stringing rods is not always adequate to that, under certain conditions, especially if the previously filed stack of writing material must be referred to very often, the interlock lossens again. Furthermore, the heretofore known device of this general type for interlocking or stringing together a stack of writing material has another disadvantage in that, for effecting the interlock, a great number of different both as to size and as to construction space-demanding parts is required, due to which stock-keeping is rendered more difficult and handling of the device during the interlocking of a stack of writing material is rendered more complicated. Likewise, it is not readily possible, with the heretofore known device, to string together writing material of extremely different thickness space-savingly and so as to be clearly writable thereon. A very thin stack leaves too much space open between the front side of the writing material and the binding strip or cover to be snapped thereon but, on the other hand, when the stack is too thick, the pre-folded binding strip anchored to the stringing rods cannot be snapped over the front side of the writing material.

It is accordingly an object of the invention to provide a device for interlocking a stack of writing material having perforations formed therein along a margin thereof which avoids the foregoing disadvantages of the heretofore known device of this general type.

It is a further object of the invention to provide such a device which affords reliable securing of a stack of writing material having varying height in a relatively simplified manner and which, due to the interlocking of structural parts, is advantageously distinguished in the production as well as in the storage or stock-keeping thereof, and which always ensures an attractive appearance of an interlocked stack of writing material.

With the foregoing and other objects in view, there is provided, in accordance with the invention, a device for interlocking a stack of writing material having perforations formed therein along a margin thereof, the perforations formed in the writing material being aligned in the stack thereof so as to form respective through-bores extending from opposite marginal surfaces of the stack that are disposed adjacent to and on both sides of a back surface of the stack, comprising two binding strips of identical construction, each of the binding strips having a first portion engageable with the back of the writing-material stack for covering at least part thereof, and a second portion engageable with and covering a respective one of the opposite marginal surfaces of the stack, each of the binding strips further having stringing rods and sleeves extending from the respective second portion thereof, the rods and sleeves being disposed in mutually alternating sequence and having a mutual spacing corresponding to the spacing of the aligned holes formed in the stack of writing material, the rods being formed with outer detents along the length thereof and the sleeves being formed with corresponding inner detents along the length thereof, the rods of each of the two binding strips being lockingly engageable in the sleeves of the other of the two binding strips by the detents thereof within the respective through-bores formed in the stack of writing material.

In accordance with another feature of the invention, the first portion of the binding strip is a crosspiece interconnecting the respective rods and sleeves mutually spaced in alternating sequence, and the second portion of the binding strip is a side board extending angularly from the crosspiece.

In accordance with a further feature of the invention, the side boards simultaneously serve as carrier for an inscribable book back.

In accordance with an added feature of the invention, the rods and sleeves of the binding strips are formed, respectively, of crosspieces and shafts having a rectangular cross section, the detents of the rods being formed externally on opposite crosspiece sides thereof, and the detents of the sleeves being formed internally on opposite shaft sides of the sleeves and having a profile corresponding to that of the detents formed on the crosspiece sides.

In accordance with an additional feature of the invention, the detents have a sawtooth profile.

In accordance with an alternate feature of the invention, the detents have a wave-shaped profile.

In accordance with yet another feature of the invention, the rods and sleeves of the binding strips have a round profile.

In accordance with yet a further feature of the invention, each of the stringing rods is formed with an elongated slot.

In accordance with another feature of the invention, each of the stringing rods has a slight conicity at the free end thereof.

In accordance with a further feature of the invention, the binding strip is formed of elastic resilient material.

In accordance with a concomitant feature of the invention, the material is severable synthetic material.

Other features which are considered as characteristic for the invention are set forth in the appended claims.

Although the invention is illustrated and described herein as embodied in a device for interlocking perforated writing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
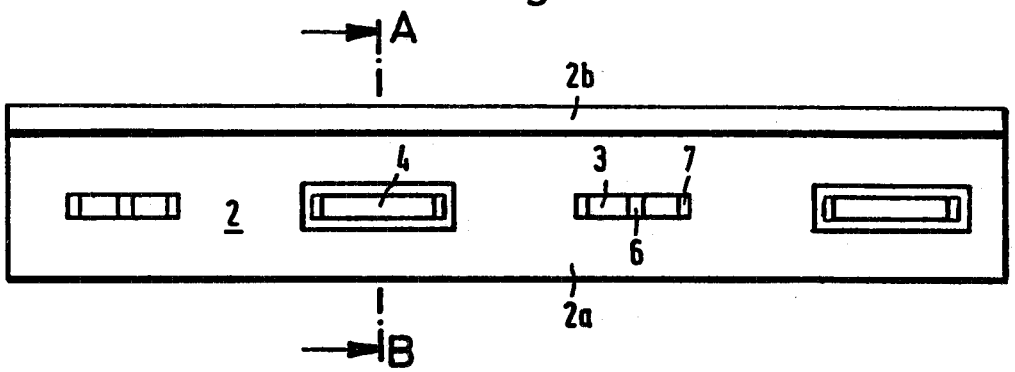
FIG. 2 is a plan view of a binding strip constructed in accordance with the invention.
Figure 3:
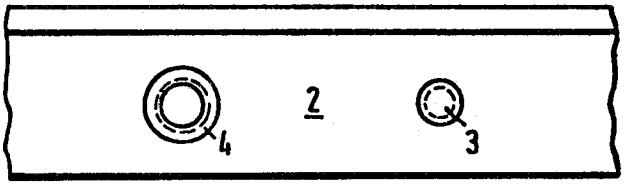
Figure 2A:
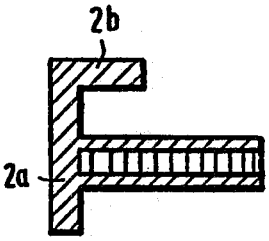
Figure 4:
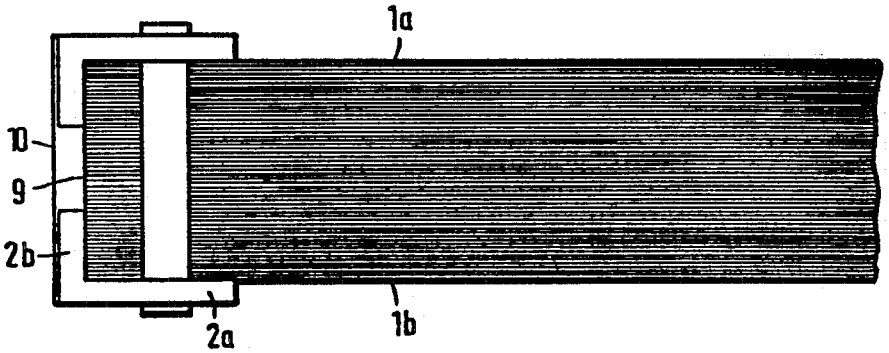

FIG. 2*a* is a cross-sectional view of FIG. 2 taken along the line A-B in the direction of the arrows;

FIG. 3 is a plan view of another embodiment of a binding strip constructed in accordance with the invention; and FIG. 4 is an end view of a completely interlocked writing material stack in accordance with the invention.

Figure 1:
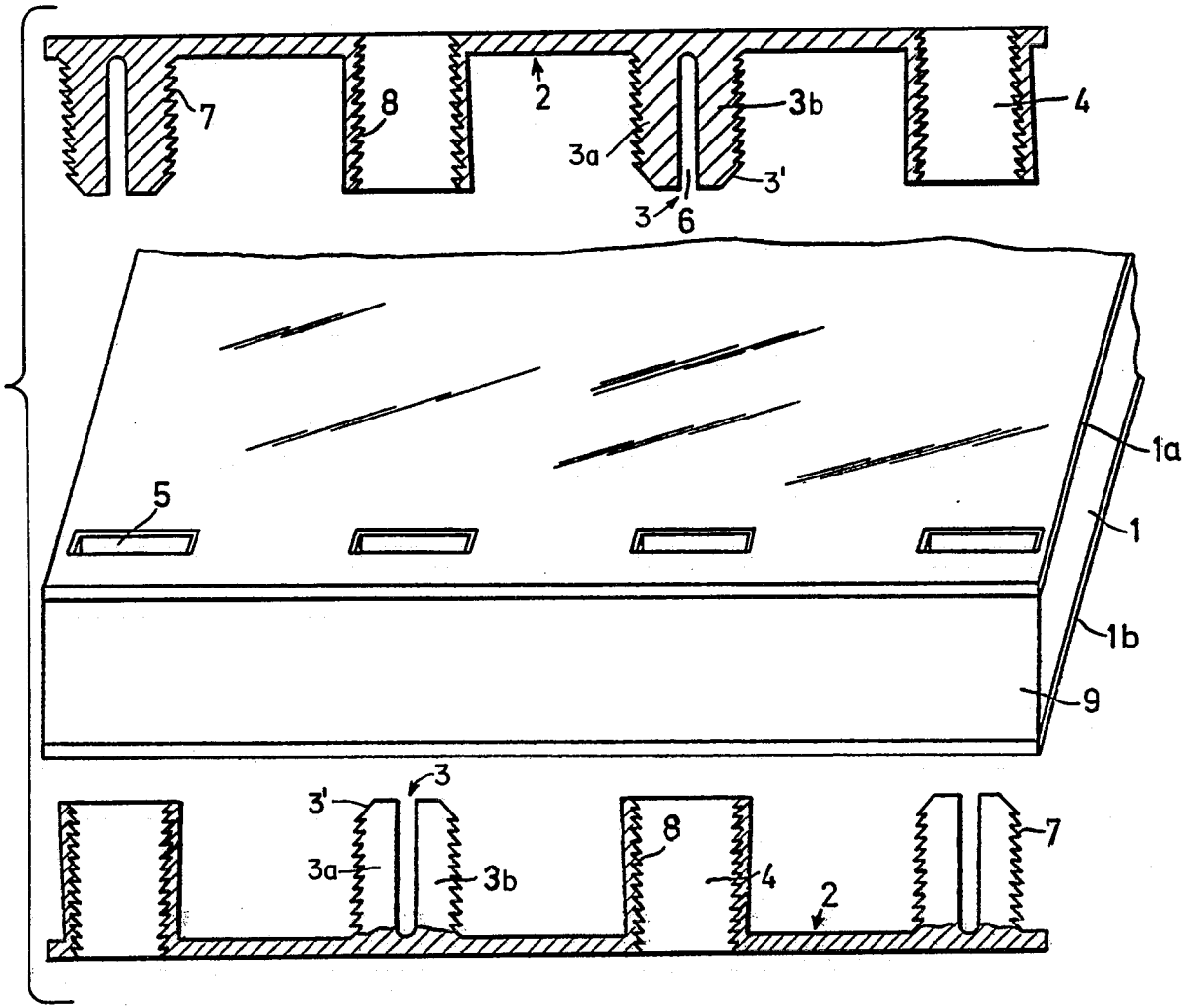
FIG. 1 is a partly perspective, partly sectional exploded view of a device for interlocking a stack of writing material.

Referring now to the figures and first, particularly, to FIG. 1 thereof, there is shown a device for interlocking a stack 1 of writing material having a front side 1*a* and a rear side 1*b*. The interlocking device is formed of two similarly constructed binding strips 2 in the form of a strip crosspiece 2*a* of rubber-like elastic resilient material, preferably thin-walled severable synthetic material, which are, respectively, firmly connected to stringing rods 3 and sleeves 4 that are aligned with and uniformly spaced from one another in alternating sequence. The rods 3 and sleeves 4 are in the form, respectively, of rectangular or parallelpipedal rod crosspieces 3*a*, 3*b* and shafts. The mutual spacing of the stringing rods 3 and sleeves 4 corresponds to the spacing of rectangular stringing holes in the writing-material stack 1 that is to be strung up. Each stringing rod 3, which is rectangularly profiled has an outer cross section corresponding to the inner cross section of the sleeves 4 and has a slight conicity 3' at the upper or free end thereof and is provided in the middle thereof with a longitudinal slot 6 for attaining a spring action thereby. The outer cross section of the sleeves 4 are rectangularly profiled corresponding to the cross section of the stringing holes 5. The stringing rods 3 and the sleeves 4 are connected to the binding strip 2. In addition, each stringing rod 3 is formed with detents 7 at the outside thereof, on the mutually opposite narrow rod crosspiece sides 3*a*, 3*b* thereof. The detents 7 formed on the stringing rods 3 are associated with correspondingly profiled detents 8 formed on opposite sides within the sleeve shaft of the sleeves 4. The detents 7 and 8 are formed with a sawtooth shape, the inclination of the teeth running one-sidedly from top to bottom i.e. in direction of the binding strip 2. This type of detent toothing ensures a non-loosening or non-releasable interlock of the writing-material stack. A loosenable or releasable interlocking of the writing-material stack 1 is possible if the detent toothing extends on both sides with the same tooth slope or inclination or, instead of sawtooth-like profiled detents 7, 8, wave-profiled detents 7, 8 or the like may be provided. Likewise, it is possible to employ, instead of rectangular stringing rods 3 or sleeves 4, such rods 3 or sleeves 4 having a round profile and circular detents as shown in FIG. 3.

The crosspiece 2*a* connecting the stringing rods 3 and sleeves 4 of a binding strip 2 to one another is selectively provided with such a width that at least the margins of the book together with the stringing holes 5 of the writing-material stack 1 are completely covered. Each binding strip 2 is additionally provided with a side board 2*b*, as clearly shown in FIGS. 2 and 2*a*, which is injection-molded to the strip crosspiece 2*a*. Depending upon the thickness of the writing-material stack 1 (FIGS. 1 and 4), the back 9 of the writing material will be entirely or partly covered by the side boards 2*b*. When a writing-material stack 1 (FIG. 4) has been interlocked, the oppositely disposed side boards 2*b* of both binding strips 2 serve simultaneously as supports for an inscribable book back 10 for describing or providing the contents of the writing-material stack 1. This book back 10 can be self-adhesive, for example, or the like.

The interlocking of a writing-material stack 1 is explained in further detail hereinafter. The device therefor employs two binding strips 2 (FIG. 2), of which the rods 3 and sleeves 4 of one of the strips 2 is stuck from the front side 1*a* of the writing-material stack 1 and the rods 3 and sleeves 4 of the other of the strips 2 is stuck from the rear side 1*b* of the stack 1 through the accessible stringing through-holes 5 in the writing-material stack 1 according to FIG. 1. Since both binding strips 2 are similarly constructed, the association thereof with the front side 1*a* or the rear side 1*b* of the writing-material stack 1 is freely selectable. Under pressure exerted on the binding strips 2, the stringing rods 3 with the external detents 7 of the one binding strip 2, due to the slight conicity thereof, reliably engage in the detents 8 of the sleeves 4 of the opposing binding strip 2 and vice versa, the spring action achieved through the elongated slots 6 formed in the stringing rods 3 facilitating the pressing-together of both binding strips 2. The shape and construction of the detent toothing according to the invention subsequently holds the pages of the writing-material stack inseparably together. Depending upon the thickness of the stack of writing material, the stringing rods 3 engage more or less deeply in the sleeves 4 or the sleeve shafts of the binding strips 2. Outwardly protruding ends of the stringing rods 3 and the sleeves 4, when a thin stack 1 of writing material is used, as shown in FIG. 4, can be readily severed due to the employment of rubber-elastic synthetic materials for the binding strips 2, such as plasticized gamma polyvynil chloride or polymeric acrylates or meth acrylates or the like.

There are claimed:

1. Device for interlocking a stack of writing material having perforations formed therein along a margin thereof, the perforations formed in the writing material being aligned in the stack thereof so as to form respective through-bores extending from opposite marginal surfaces of the stack that are disposed adjacent to and on both sides of a back surface of the stack, comprising two binding strips of monolithic identical construction, each of said binding strips having a first portion engageable with the back of the writing-material stack for covering at least part thereof, and a second portion engageable with and covering a respective one of the opposite marginal surfaces of the stack, each of said binding strips further having stringing rods and sleeves extending from the respective second portion thereof, said rods and sleeves being disposed in mutually alternating sequence and having a mutual equal spacing corresponding to the spacing of the aligned holes formed in the stack of writing material, said rods being formed with outer detents along the length thereof and said sleeves being formed with corresponding inner detents along the length thereof, the rods of each of the two binding strips being lockingly engageable in the sleeves of the other of the two binding strips by said detents thereof within the respective through-bores formed in the stack of writing material.

2. Device according to claim 1 wherein said side boards simultaneously serve as carrier for an inscribable book back.

3. Device according to claim 1 wherein each of said stringing rods is formed with an elongated slot.

4. Device according to claim 1 wherein each of said stringing rods has a slight conicity at the free end thereof.

5. Device according to claim 1 wherein said binding strip is formed of elastic resilient material.

6. Device according to claim 1 wherein said material is a severable synthetic material.

7. Device according to claim 1 wherein said rods and sleeves of said binding strips are formed, respectively, of rod crosspieces and shafts having a rectangular cross section, said detents of said rods being formed externally on opposite rod crosspiece sides thereof, and said detents of said sleeves being formed internally on opposite shaft sides of said sleeves and have a profile corresponding to that of the detents formed on said rod crosspiece sides.

8. Device according to claim 7 wherein said detents have a sawtooth profile.

9. Device according to claim 1 wherein said second portion of said binding strip is a strip crosspiece interconnecting the respective rods and sleeves mutually spaced in alternating sequence, and said first portion of said binding strip is a side board extending angularly from said strip crosspiece.

10. Device according to claim 9 wherein said rods and sleeves of said binding strips have a round profile.

11. The device according to claim 9 wherein said side boards simultaneously serve as carrier for an inscribable book back.

12. The device according to claim 9 wherein said rods and sleeves of said binding strips are formed, respectively, of rod crosspieces and shafts having a rectangular cross section, said detents of said rods being formed externally on opposite rod crosspiece sides thereof, and said detents of said sleeves being formed internally on opposite shaft sides of said sleeves and have a profile corresponding to that of the detents formed on said rod crosspiece sides.

13. The device according to claim 12 wherein said detents have a sawtooth profile.

* * * * *

UNITED STATES PATENT AND TRADEMARK OFFICE

CERTIFICATE OF CORRECTION

PATENT NO. : 4,175,880

DATED : November 27, 1979

INVENTOR(S) : Wilhelm Muller

It is certified that error appears in the above—identified patent and that said Letters Patent is hereby corrected as shown below:

On the title page, item /30/ Foreign Application Priority Data should be deleted in its entirety.

Signed and Sealed this

*Fifteenth* Day of *July 1980*

[SEAL]

*Attest:*

SIDNEY A. DIAMOND

*Attesting Officer*

*Commissioner of Patents and Trademarks*